US008839852B2

(12) United States Patent
In

(10) Patent No.: US 8,839,852 B2
(45) Date of Patent: Sep. 23, 2014

(54) EXCAVATOR

(76) Inventor: Suk-Shin In, Gwangju (KR)

( * ) Notice: Subject to any disclaimer, the term of this patent is extended or adjusted under 35 U.S.C. 154(b) by 640 days.

(21) Appl. No.: 12/745,510

(22) PCT Filed: Dec. 8, 2008

(86) PCT No.: PCT/KR2008/007258

§ 371 (c)(1),
(2), (4) Date: Oct. 26, 2010

(87) PCT Pub. No.: WO2009/072855

PCT Pub. Date: Jun. 11, 2009

(65) Prior Publication Data

US 2011/0048807 A1 Mar. 3, 2011

(30) Foreign Application Priority Data

Dec. 6, 2007 (KR) ..... 10-2007-0126452

(51) Int. Cl.

| | |
|---|---|
| ***E21B 19/24*** | (2006.01) |
| ***E02D 1/04*** | (2006.01) |
| ***E02D 7/14*** | (2006.01) |
| ***E02D 7/20*** | (2006.01) |
| ***E02D 5/52*** | (2006.01) |
| ***E02D 13/04*** | (2006.01) |

(52) U.S. Cl.

CPC .. *E02D 7/20* (2013.01); *E02D 1/04* (2013.01); *E02D 7/14* (2013.01); *E02D 5/523* (2013.01); *E21B 19/24* (2013.01); *E02D 13/04* (2013.01)

USPC ..... 166/77.53; 166/77.51; 166/85.5; 175/162; 175/203; 175/220

(58) Field of Classification Search

USPC ..... 166/378–380, 77.51, 77.52, 77.53, 166/85.5; 175/203, 85, 162, 220, 195

See application file for complete search history.

(56) References Cited

U.S. PATENT DOCUMENTS

| | | | | |
|---|---|---|---|---|
| 2,690,847 | A * | 10/1954 | Crookston | 414/22.51 |
| 3,158,212 | A * | 11/1964 | Fanshawe et al. | 175/85 |
| 3,158,213 | A * | 11/1964 | O'Neill et al. | 175/85 |
| 3,194,313 | A * | 7/1965 | Fanshawe | 166/77.53 |
| 3,464,507 | A * | 9/1969 | Smith et al. | 175/85 |
| 3,741,322 | A * | 6/1973 | Wolters | 175/52 |
| 4,440,536 | A * | 4/1984 | Scaggs | 414/22.51 |
| 4,605,077 | A * | 8/1986 | Boyadjieff | 175/85 |
| 5,595,248 | A * | 1/1997 | Denny | 166/379 |
| 6,227,311 | B1 * | 5/2001 | Osadchuk | 175/53 |
| 7,350,587 | B2 * | 4/2008 | Springett et al. | 166/380 |
| 7,743,834 | B2 * | 6/2010 | Bouligny | 166/380 |
| 7,814,994 | B2 * | 10/2010 | Franzen | 175/220 |
| 2002/0043403 | A1 * | 4/2002 | Juhasz et al. | 175/40 |

(Continued)

FOREIGN PATENT DOCUMENTS

| | | |
|---|---|---|
| JP | 2001-220985 A | 8/2001 |
| JP | 2007-132090 A | 5/2007 |

*Primary Examiner* — Blake Michener

(74) *Attorney, Agent, or Firm* — Lexyoume IP Meister, PLLC

(57) ABSTRACT

An excavator is provided, in which the excavator includes a head that is slidably mounted on a leader, and a position fixture assembly slidable along the leader via the head. The position fixture includes a support plate including a groove in it top surface, with a first rod slidable within the groove. The position fixture also including a locking unit that serves to engage a base member, allowing the base member to be elevated when the head is elevated.

1 Claim, 7 Drawing Sheets

(56) References Cited

U.S. PATENT DOCUMENTS

2002/0170720 A1* 11/2002 Haugen ..... 166/379
2004/0069500 A1* 4/2004 Haugen ..... 166/380
2006/0113075 A1* 6/2006 Springett et al. ..... 166/77.52
2006/0113084 A1* 6/2006 Springett et al. ..... 166/379
2006/0113087 A1* 6/2006 Springett et al. ..... 166/380
2006/0278400 A1* 12/2006 Bouligny ..... 166/379
2007/0017703 A1* 1/2007 Belik ..... 175/52
2007/0095524 A1* 5/2007 Lesko ..... 166/77.1
2007/0251701 A1* 11/2007 Jahn et al. ..... 166/379

* cited by examiner

EXCAVATOR

TECHNICAL FIELD

The present invention relates to an excavator, and more particularly to an excavator in which a first rod is assembled with a second rod that is previously inserted into a hole perforated by a hammer by simply aligning the first rod with the second rod.

BACKGROUND ART

In general, an excavator is used to excavate deep holes into the ground for purposes of boring, soil testing or development of underground water.

A conventional excavator is disclosed in Korean Patent No. 624233.

The disclosed excavator comprises a main body having a driving device such as an engine, a leader supported by the main body, and a head sliding along the leader and generating an elevational force or a rotational force by a driving device provided in the main body.

In addition, the excavator comprises a rod assembled with the head and inserted into a deep hole while elevating or rotataing, and an excavating unit installed at a front end of the rod and perforating the deep hole into the ground while elevating or rotataing.

The excavating unit includes a beat striking and excavating the ground and a hammer operated by a hydraulic pressure to apply a striking force to the beat. The hydraulic pressure can be transferred to the excavating unit by means of a separate hydraulic line installed at the rod.

The excavator is configured to excavate the ground to a predetermined depth such that the beat of the excavating unit rotates or strikes the ground. As the excavating unit excavates the ground, the excavating unit and the rod are inserted into the ground. If the rod is inserted into the ground to the predetermined depth, a new rod is assembled with the rod previously inserted into the ground and the new rod and the previously inserted rod are both inserted into the ground.

In other words, multiple rods are coupled with each other and the coupled rods are inserted into the hole perforated by the excavating unit.

In order to couple an additional rod to a rod that is previously inserted the perforated hole, a rod clamp for supporting the previously inserted rod is provided at an end of the leader.

The aforementioned excavator performs a new rod assembling process in the following manner.

First, the head is separated from the rod previously inserted into the ground and the new rod is connected to the head. Then, the new rod is assembled with the previously inserted rod.

However, since the rod is several meters long, the new rod assembled with the head may severely vibrate. The vibrating of the new rod makes it difficult to align a assembled portion of the new rod with a assembled portion of the previously inserted rod, thereby resulting in inconvenience in connecting the rods to each other.

DISCLOSURE OF INVENTION

Technical Problem

To solve the above problems, it is an object of the present invention to provide an excavator in which a new rod assembled with a previously inserted rod can be supported to a head without vibration.

Technical Solution

According to an aspect of the present invention, there is provided an excavator comprising a body, a leader supported by the body, a head sliding along the leader, a first rod assembled with the head to then be elevated or rotated by the head, a rod clamp installed at a front end of the leader and clamping a second rod inserted into the ground, and a position fixture sliding along the leader by means of the head and fixing the position of the first rod when connecting the first rod to the second rod.

The position fixture includes a base member slidably installed on the leader, a support plate installed at one side of the base member and having a support groove on its top surface such that the first rod is position-supported, and a locking unit installed at the other side of the base member and allowing the base member to elevate by being interfered when the head elevates.

BEST MODE FOR CARRYING OUT THE INVENTION

Hereinafter, an exemplary embodiment of the present invention will be described with reference to the accompanying drawings.

Figure 1:
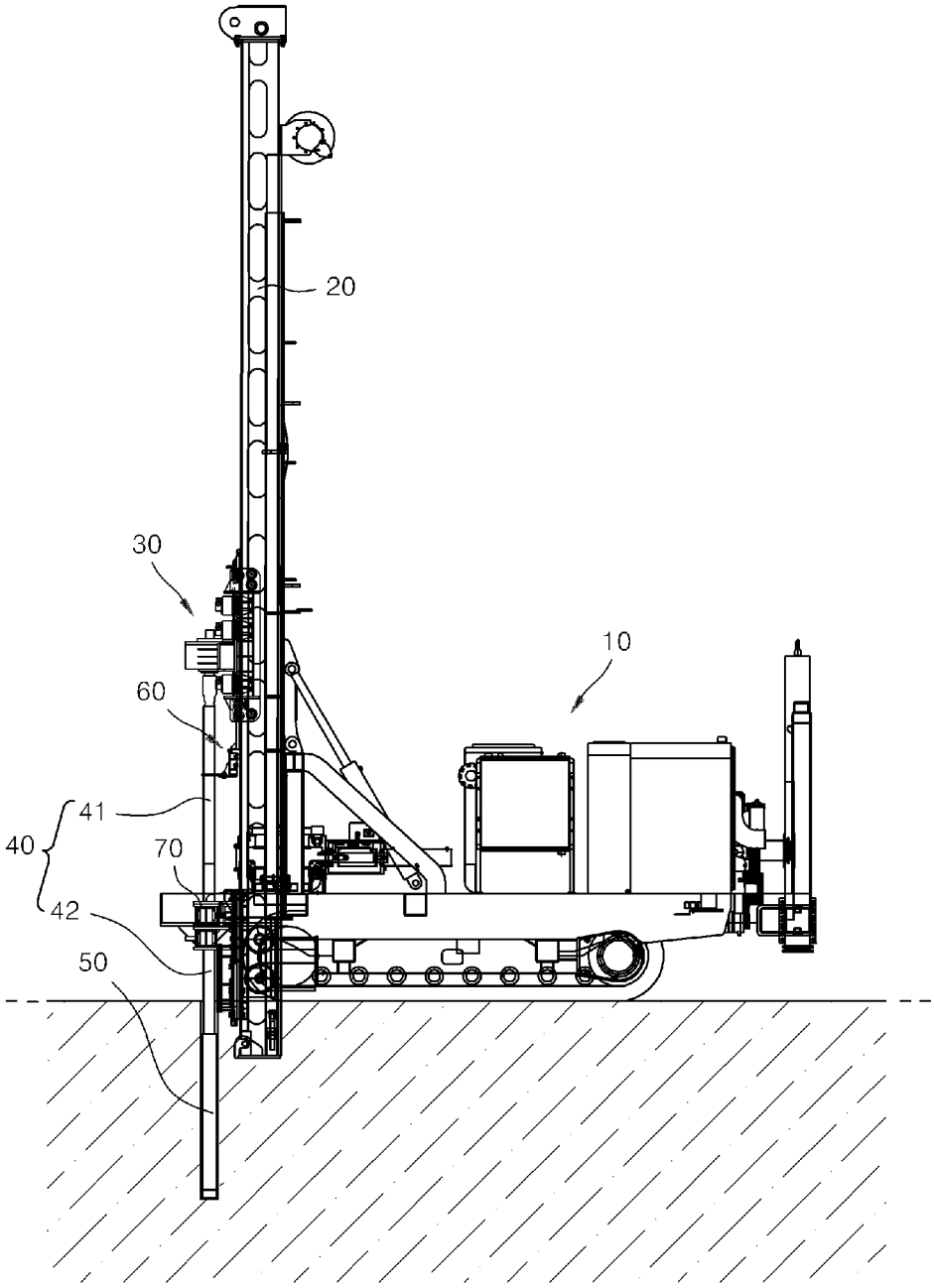
FIG. 1 is a diagram showing an excavator according to an exemplary embodiment of the present invention.

FIG. 1 shows a structure of an excavator according to an exemplary embodiment of the present invention.

Referring to FIG. 1, the excavator according to an exemplary embodiment of the present invention includes a body 10 having an engine and a driving device 32, a leader 20 supported by the body 10 and having a predetermined length, a head 30 sliding along the leader 20 and generating a rotary force by the driving device 32, a rod 40 assembled with the driving device 32, a excavating unit 50 installed at a front end of the rod and excavating the ground, and a position fixture 60 sliding along the leader 20 by means of the head 30 and fixing the position of the rod assembled with the head 30 without being vibrated.

A rod clamp 70 is installed at an end of the leader 20 close to the ground and clamps the rod 40.

The head 30 includes a frame 31 and the driving device 32. The frame slides along the leader 20, and the driving device 32 is installed on the frame 31 and generates a rotary force.

The position fixture 60 is a device used for fixing a position of a new rod when the new rod is assembled with a previously installed rod in order to extend a length of the rod assembled with the excavating unit 50. An exemplary embodiment of the position fixture 60 is shown in FIG. 3.

In the following, for brevity of explanation, a rod that is assembled with the excavating unit 50 and is previously inserted into the ground is to be referred to as a second rod 42, and a new rod that is to be assembled with the second rod 42 is to be referred to as a first rod 41.

Figure 2:
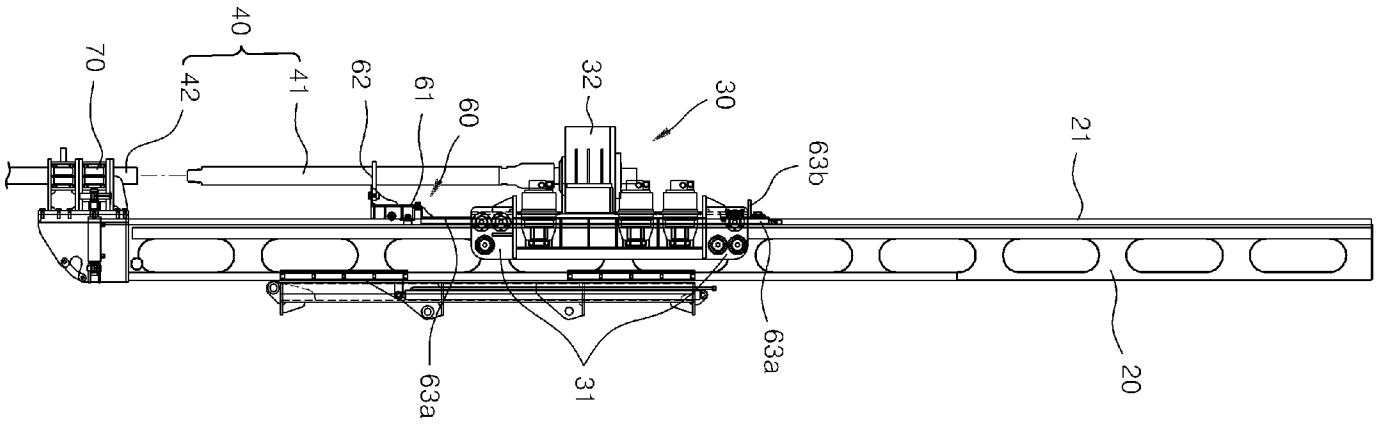
FIG. 2 is a diagram showing a leader having a position fixture and a head in the excavator shown in FIG. 1.

Referring to FIG. 2, when the first rod 41 is assembled with the second rod 42 clamped by the rod clamp 70 in a state in which it is assembled with the driving device 32 of the head 30, the position fixture 60 prevents the first rod 42 from being shaken and accurately aligns the first rod 42 with the second rod 42.

Figure 3:
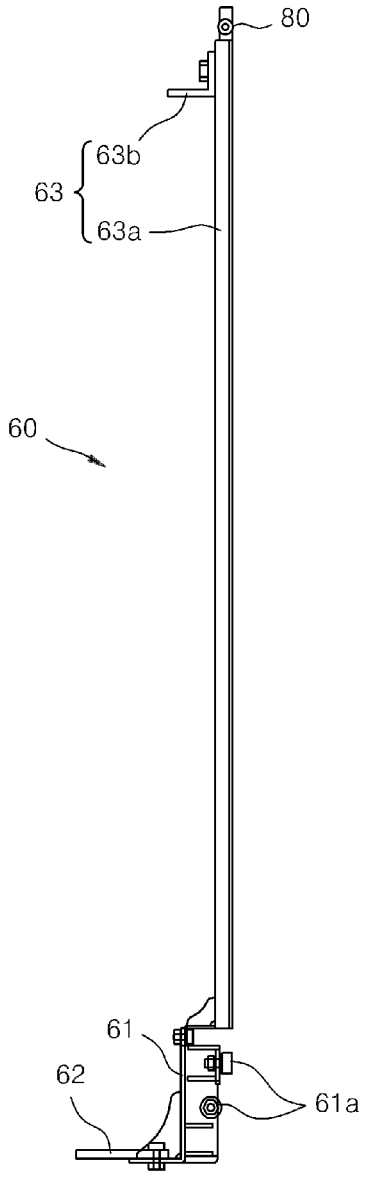
FIG. 3 is a diagram showing an exemplary embodiment of the position fixture of the excavator shown in FIG. 1.
Figure 4:
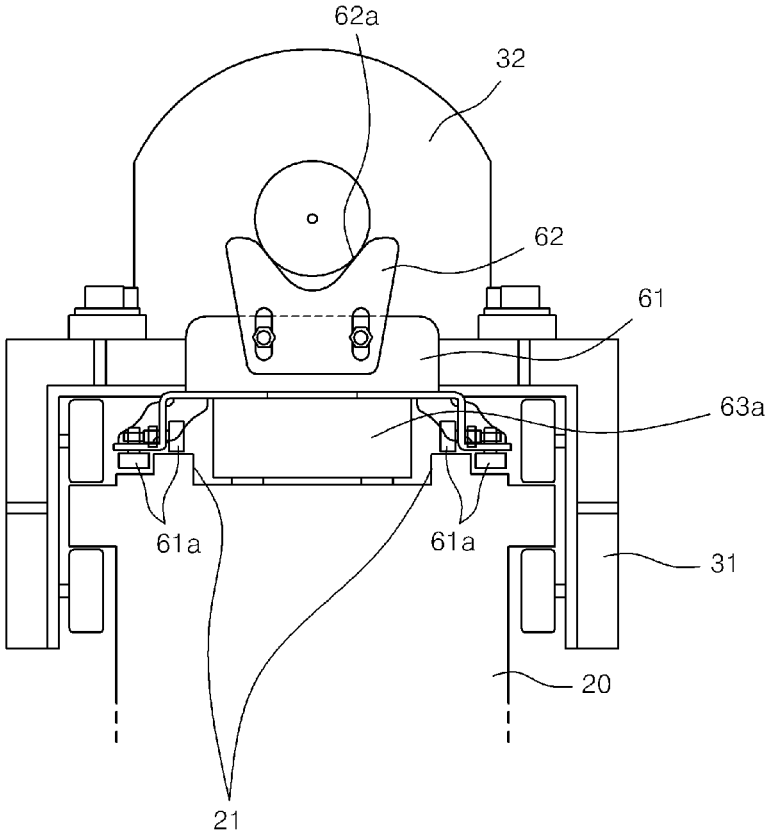
FIG. 4 is a sectional diagram showing a state in which a position fixture is installed in a leader in the excavator shown in FIG. 1.
Figure 5:
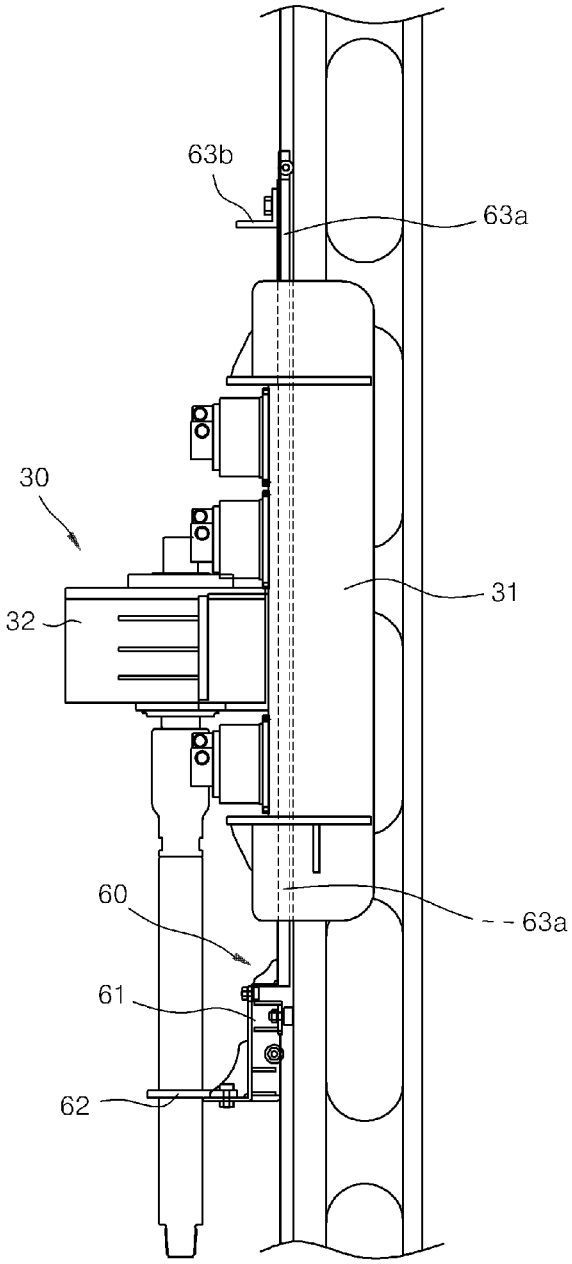
FIG. 5 is a side elevational view showing a state in which a position fixture is installed in a leader in the excavator shown in FIG. 1.

Referring to FIGS. 3 through 5, the position fixture 60 includes a base member 61 slidably installed on the leader 20, a support plate 62 installed at one side of the base member 61 and fixedly inserted by the first rod 41, and a locking unit 63 installed at the other side of the base member 61 and allowing the base member 61 to be elevated such that the locking unit 63 is locked on the frame 31 of the head 30 elevated along the leader 20.

The leader 20 has a sliding rail 21 allowing the base member 61 to slide.

The base member 61 has first support rollers 61*a* contacting the sliding rail 21 to facilitate a sliding operation.

The first support rollers 61*a* are installed at various locations of the base member 61 to closely contact to top and lateral surfaces of the sliding rail 21.

The support plate 62 has a support groove 62*a* having a predetermined depth formed from the edge of the support plate 62 so that the first rod 41 is inserted into the support groove 62*a* to then be fixed.

The support groove 62*a* has a width so large that the first rod 41 is inserted thereinto.

Here, the support groove 62*a* inwardly slopes such that the first rod 41 is inserted thereinto to then be fixed without vibration. That is to say, the support groove 62*a* is formed in a "V" shape in which its width is gradually tapered.

The support plate 62 and the support groove 62*a* are designed to have appropriate dimensions such that the first rod 41 inserted into the support groove 62*a* and the second rod 42 are coaxially aligned.

The locking unit 63 includes an extension member 63*a* and a locking bracket 63*b*. The extension member 63*a* is connected to an end of the base member 61 and extends a length of the base member 61. The locking bracket 63*b* connected to an end of the extension member 63*a* so as to protrude thereat and is locked on the frame 31 when the head 30 is elevated.

The extension member 63*a* is positioned between the frame 31 of the head 30 and the leader 20 and is formed to a length long enough to expose both ends thereof to opposite sides of the frame 31 of the head 30. The extension member 63*a* has a second support roller 80 installed to facilitate a sliding operation.

The locking bracket 63*b* is installed at the end of the extension member 63*a*, i.e., at a location opposite to an end to which the base member 61 is connected. Thus, the base member 61 and the locking bracket 63*b* are positioned at both sides of the extension member 63*a* exposed to opposite sides of the frame 31 of the head 30.

Figure 6:
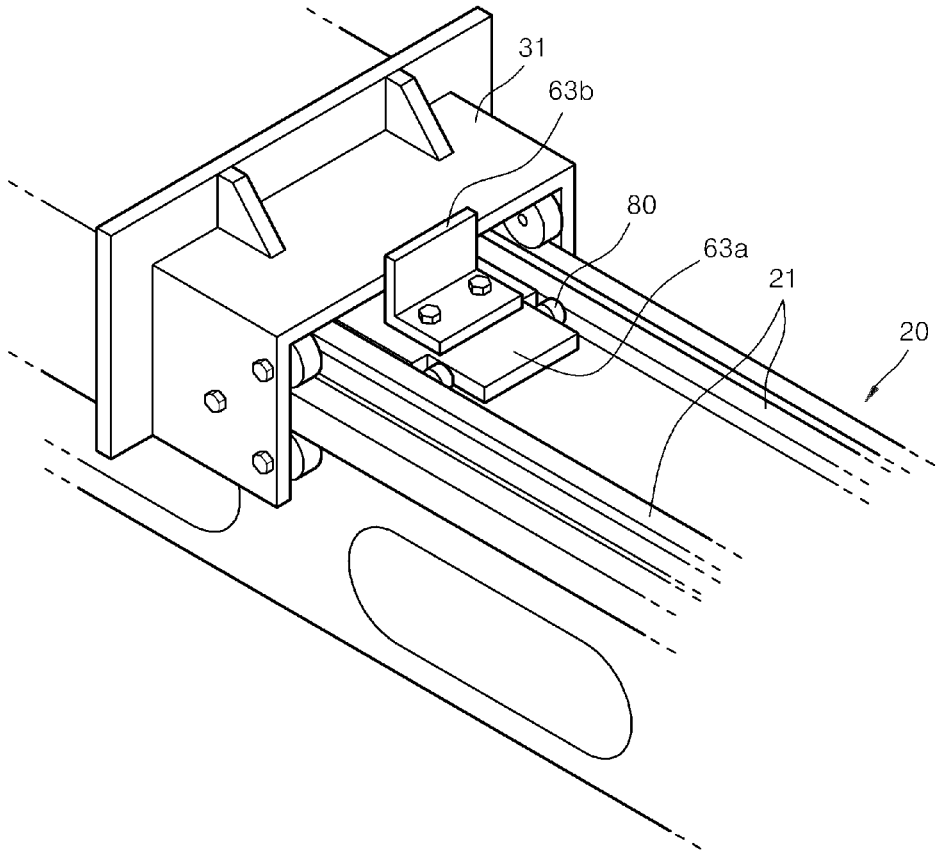
FIG. 6 is a diagram showing a state in which a locking bracket of a position fixture is locked on a frame of a head in the excavator shown in FIG. 1.

Referring to FIG. 6, the locking bracket 63*b* has a sufficiently long height so as to be locked on the frame 31 when the frame 31 of the head 30 is elevated along the leader 20. Thus, since the locking bracket 63*b* is locked on the frame 31 when the frame 31 of the head 30 is elevated, the base member 61 and the locking bracket 63*b* are elevated together with the frame 31 of the head 30.

In the aforementioned excavator according to the exemplary embodiment of the present invention, the operation of the position fixture in the course of assembling the first rod 41 with the second rod 42 for the purpose of extending the rod length will now be described.

When the excavating unit 50 excavates the ground to a predetermined depth, the excavating unit 50 and the second rod 42 connected to the excavating unit 50 are inserted into the ground, and the head 30 is lowered into the ground by a excavating length along the leader 20.

Here, the rod length is extended by additionally connecting the first rod 41 to the second rod 42.

Figure 7:
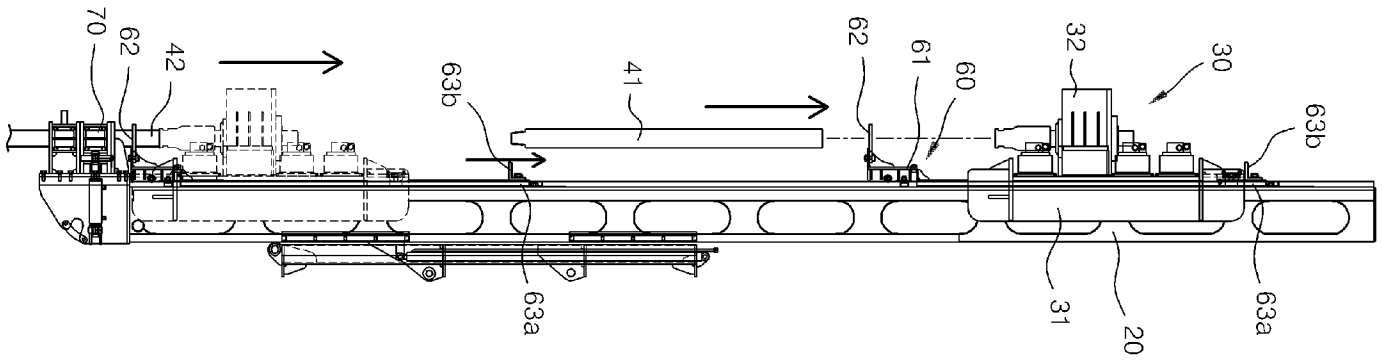
FIG. 7 is a diagram showing a rod assembling process in the excavator shown in FIG. 1.

Referring to FIG. 7, the driving device 32 of the head 30 is first separated from the second rod 42 clamped by the rod clamp 70 to elevate the frame 31 of the head 30. Here, the frame 31 is elevated along the leader 20 by a length corresponding to the length of the first rod 41. As the locking bracket 63*b* of the extension member 63*a* is locked on the frame 31, the position fixture 60 is elevated together with the frame 31.

If the frame 31 is elevated by an appropriate length, the first rod 41 is connected to the driving device 32.

The first rod 41 connected to the driving device 32 of the head 30 is laterally inserted into the support groove 62*a* of the support plate 62 to fix the position of the first rod 41. Accordingly, the first rod 41 is fixed without vibration.

The first rod 41 inserted into the support groove 62*a* is coaxially aligned with the second rod 42. As described above, in a state in which the position of the first rod 41 is fixed to the support groove 62*a* of the support plate 62, the frame 31 of the head 30 is lowered and the first rod 41 is accurately assembled with the second rod 42.

After assembling the first rod 41 and the second rod 42, the ground is perforated by the excavating unit 50 and the first rod 41 is inserted into the ground. Here, the frame 31 of the head 30 is lowered.

When the frame 31 of the head 30 is lowered, the position fixture 60 is lowered until the base member 61 is brought into contact with the rod clamp 70 due to its own weight.

The frame 31 of the head 30 is further lowered even after the position fixture 60 comes to a halt, which is preceded by the base member 61 contacting the rod clamp 70.

As described above, according to the illustrated exemplary embodiment of the present invention, the vibration of the first rod 41, which is one of problems with the prior art, can be prevented when assembling the first rod 41 and the second rod 42, using the support groove 62*a* of the support plate 62 of the position fixture 60, thereby facilitating the assembling of the first rod 41 and the second rod 42.

The excavator usually excavates the ground to a depth of approximately 2000 m. In this regard, since general rods are approximately 6 m long, multiple rods are connected to each other to lengthen the rods and the excavating work is performed. As described above, since the rods are simply assembled to each other, the excavator according to the present invention can facilitate the excavating work of the ground.

While the present invention has been particularly shown and described with reference to exemplary embodiments thereof, it will be understood by those of ordinary skill in the art that various changes in form and details may be made therein without departing from the spirit and scope of the present invention as defined by the following claims.

It is therefore desired that the present embodiments be considered in all respects as illustrative and not restrictive, reference being made to the appended claims rather than the foregoing description to indicate the scope of the invention.

INDUSTRIAL APPLICABILITY

According to the present invention, since a new rod can be assembled with a rod that is previously inserted into the ground and clamped by a rod clamp by means of a position fixture without vibration, a new rod assembling work can be easily performed in excavating deep holes into the ground for purposes of boring, soil testing or development of underground water.

The invention claimed is:

1. An excavator comprising:

a body including a driving device generating a rotating driving force;

a leader supported by the body and having a predetermined length;

a head including a frame which is sliding along the leader and fixing a top portion of a first rod;

a rod clamp installed at a bottom end of the leader and clamping a second rod inserted into the ground; and a position fixture sliding along the leader by means of the head and aligning the first rod with the second rod when assembling the first rod and the second rod, wherein the position fixture includes:

a base member slidably installed on the leader, the base member having a first side and a second side opposite the first side, a support plate positioned adjacent the first side of the base member and including a support groove, into which a bottom portion of the first rod is laterally inserted for coaxially aligning the position of the first rod with the second rod clamped by the rod clamp, and a locking unit positioned adjacent the second side of the base member and including a locking bracket, wherein, in a case where the head is elevated and the locking bracket is locked on the frame of the head, the position fixture is elevated together with the head and wherein, in a case where the head is lowered, the position fixture is lowered together with the head until the base member is brought into contact with the rod clamp and comes to a halt after the base member is brought into contact with the rod clamp, thereby the locking bracket being disengaged from the frame of the head.

* * * * *